United States Patent [19]

Hollstein et al.

[11] Patent Number: 4,986,210

[45] Date of Patent: Jan. 22, 1991

[54] APPARATUS FOR COATING PIPE THREADS

[75] Inventors: Thomas E. Hollstein, Amherst, Ohio; Larry W. Keefer, Wichita, Kans.; Terrence M. Fulkerson, Parma, Ohio; Kenneth W. Gray, Odessa, Tex.

[73] Assignee: Nordson Corporation, Westlake, Ohio

[21] Appl. No.: 258,151

[22] Filed: Oct. 14, 1988

[51] Int. Cl.[5] ..... B05C 1/02

[52] U.S. Cl. ..... 118/629; 118/308; 118/411; 118/423; 228/37; 228/39; 239/295

[58] Field of Search ..... 118/308, 313, 320, 310, 118/620, 627, 629, 621; 427/195; 239/290, 292, 295, 299, 552, 300; 228/37, 39

[56] References Cited

U.S. PATENT DOCUMENTS

| | | | |
|---|---|---|---|
| 2,631,949 | 3/1953 | Kronthal | 118/315 |
| 2,946,696 | 7/1960 | Lopenski | 427/106 |
| 2,953,483 | 9/1960 | Torok | 427/109 |
| 3,147,142 | 9/1964 | Rudo | 118/301 |
| 3,245,376 | 4/1966 | Romstadt | 118/314 |
| 3,323,934 | 6/1967 | Point | 118/627 |
| 3,416,492 | 12/1968 | Greenleaf | 118/308 |
| 3,532,072 | 10/1970 | Kiwiet | 118/301 |
| 3,672,927 | 6/1972 | Spiller et al. | 427/28 |
| 3,702,107 | 11/1972 | Rood et al. | 118/684 |
| 3,802,908 | 4/1974 | Emmons | 118/320 |
| 3,816,165 | 6/1974 | Horvath et al. | 427/236 |
| 3,903,842 | 9/1975 | Bowling | 118/301 |
| 3,937,179 | 2/1976 | Goodridge | 118/301 |
| 4,239,431 | 12/1980 | Davini | 118/323 |
| 4,346,667 | 8/1982 | Stamets et al. | 118/622 |
| 4,472,451 | 9/1984 | Mulder | 427/28 |
| 4,542,040 | 9/1985 | Nowak | 118/308 |
| 4,857,367 | 8/1989 | Thorn et al. | 427/348 |

FOREIGN PATENT DOCUMENTS

| | | | |
|---|---|---|---|
| 0642016 | 1/1979 | U.S.S.R. | 118/63 |

*Primary Examiner*—Willard Hoag

*Attorney, Agent, or Firm*—Wood, Herron & Evans

[57] ABSTRACT

Apparatus for coating the endmost threaded section of a pipe with corrosion resistant powder coating material by rotating the pipe and spraying the section to be coated with electrostatically charged, air-entrained powder through two stationary nozzles, one of which is directed at the section to be coated, and the other of which is directed at the chamfered end of the pipe. To prevent overspray of the powder from contacting the pipe adjacent to the area to be coated, a pair of air nozzles are directed at the area of the pipe adjacent to the area to be coated.

11 Claims, 1 Drawing Sheet

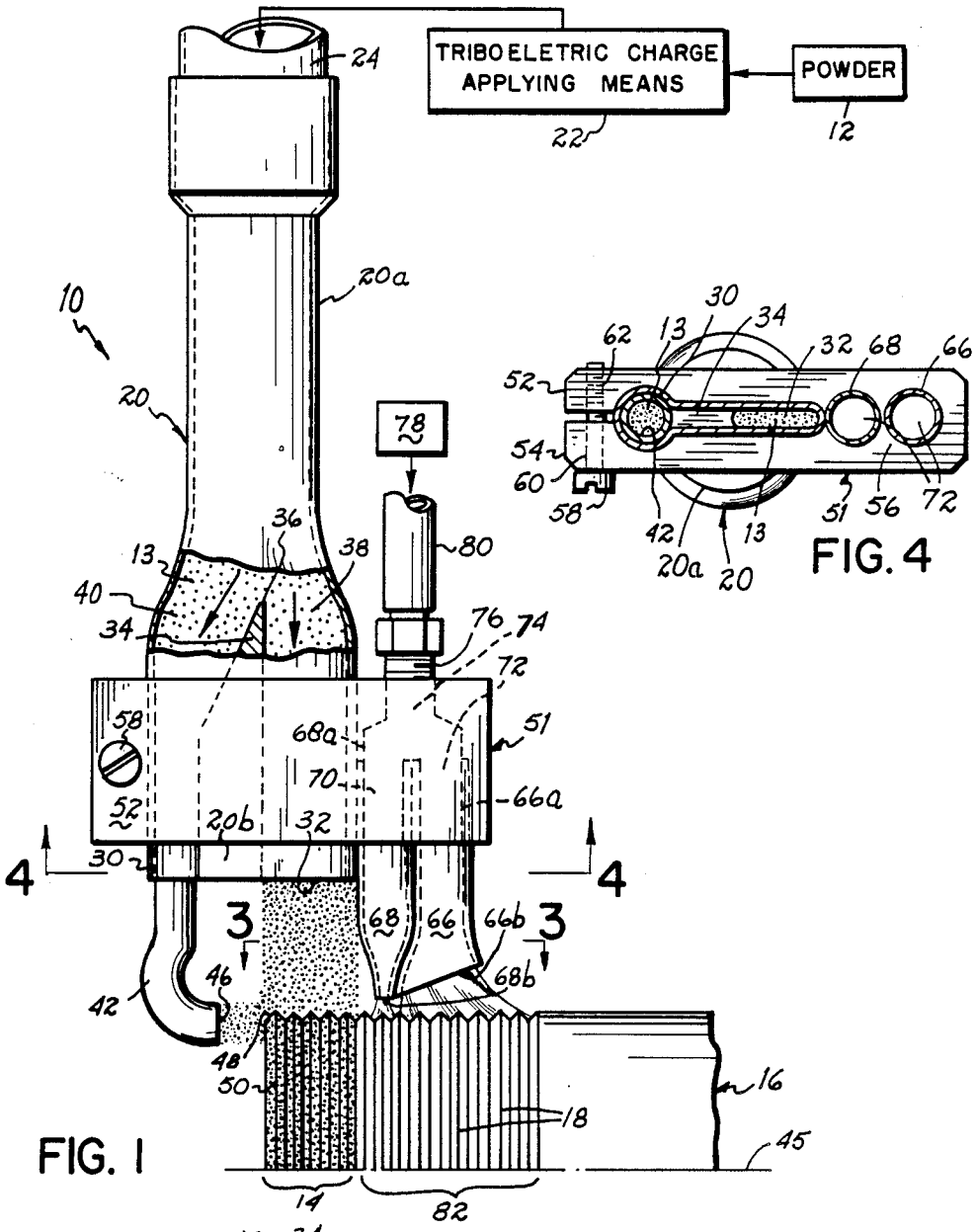
FIG. 1
FIG. 4
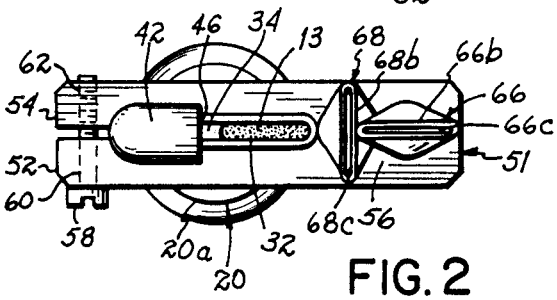
FIG. 2
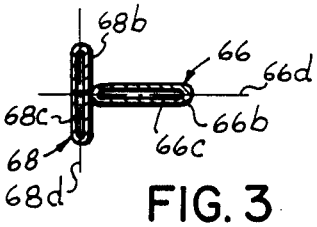
FIG. 3

APPARATUS FOR COATING PIPE THREADS

This invention relates to the coating of pipe threads, and more particularly, to the coating of threads of pipe used in the oil and gas industry.

It is now common practice to coat the endmost threads of pipes used in the oil and gas industries with a corrosion resistant coating. The purpose of the coating is to act as a seal to prevent leakage of corrosive oil through the threads of the pipe and to prevent the products of corrosion from contaminating the oil or gas. Quite commonly, this coating, known as fusion bond, is a corrosion resistant coating material which is applied to the endmost threads, but is applied to less than all of the threads of the pipe. The reason for coating the endmost, but less than all, of the threads of the pipe is to enable an electrical connection to be made through the uncoated threads. Pipes in the oil and gas industry are connected end to end by a connecting coupling. Electrical continuity is required to be maintained from one pipe to the next through the connecting coupling so as to enable all of the pipes in a series of pipes to be grounded from one end ground connection. If all of the threads of the pipe were coated with the corrosion resistant coating material, the pipe could not successfully be grounded through the coupling. By coating only the endmost threads, the remaining uncoated threads can function as contact surfaces for maintaining electrical continuity from one pipe to the next through the interconnecting coupling.

Current practice for coating the endmost threads of a pipe is to spray that threaded end of a pipe with a fusion bond powder material. The pipe is heated during application of the fusion bond material to a temperature which causes the material to melt upon contact with the pipe such that when the pipe cools, the fusion bond material forms a continuous coating over the threaded end of the pipe.

One common problem characteristic of the prior art commercial practice of applying the corrosion resistant powder coating material to the threaded end of a pipe is that it is characterized by overspray, which overspray must be manually cleaned from the pipe threads by wire brushing the overspray from those threads. Furthermore, current commercial application equipment requires skill in the use of the application equipment and manual dexterity in order to obtain a uniform coating of the corrosion resistant material on the endmost threads of a pipe.

It has therefore been an objective of this invention to provide an improved method and apparatus for applying powdered fusion bond material to the endmost pipe threads of a pipe without the occurrence of any overspray or need to clean the threads of the pipe adjacent to the coated threads after the coating operation.

Still another objective of this invention has been to provide an improved method and apparatus for applying corrosion resistant coating material to the endmost pipe threads of a pipe which enables unskilled operators to achieve uniform coverage of the endmost threads of the pipe.

These objectives are achieved, and this invention is predicated in part, upon the concept of spraying electrostatically charged powder onto the endmost threads of a rotating threaded pipe while simultaneously directing a high velocity masking airstream onto the threads of the pipe adjacent to the threads which are to coated.

In the preferred practice of this invention, two gaseous streams are simultaneously directed onto the threads which are to remain uncoated. Both of these air streams are discharged from a generally oblong nozzle with the long axis of the spray pattern from one air nozzle oriented perpendicular to the rotational axis of the pipe, and the other nozzle oriented with its long axis generally parallel to the rotational axis of the pipe. Furthermore, and in accordance with the invention of this application, the air-entrained powder is sprayed from two nozzle orifices, one of which is directed onto the chamfered end and endmost thread of the pipe, and the other of which is directed onto the endmost section of the pipe which is to be coated.

The nozzle assembly which achieves this spray pattern of air-entrained powder onto the threaded end of a pipe and the spray of a high velocity airstream onto the pipe to mask the area adjacent to that section of the pipe which is to be coated comprises a generally slot-type nozzle having a divider contained therein. This divider is operative to divide the air-entrained powder stream into two separate streams, one of which is directed onto the endmost threads of the pipe, and the other of which is directed through an auxiliary nozzle onto the chamfered end of the pipe. Mounted on the exterior of the nozzle there is an adjustable bracket which supports two high pressure air nozzles. One of these nozzles is an elongated nozzle having its discharge orifice oriented perpendicular to the axis of the pipe, and the other is an elongated nozzle having its orifice oriented parallel to the axis of the pipe and located immediately adjacent to the first air nozzle.

Tribocharged powder is sprayed from both the nozzle and the auxiliary nozzle onto the rotating pipe, while compressed air is sprayed onto the pipe by the air nozzles. This simultaneous spraying occurs while the pipe is electrically grounded and while rotated. The electrostatically charged powder adheres to the threads of the pipe while the airstreams of the air nozzles mask the area immediately adjacent to the threads which are to be coated.

The result of the practice of coating the endmost threads of a pipe utilizing the powder spray apparatus and method of this invention is that it eliminates any need to physically mask the threads which are not to be coated and which are located immediately adjacent to the endmost threads which are to be coated. It also eliminates most, if not all, of the postapplication cleanup of the threads adjacent to the coated threads. The practice of this invention also has the advantage of resulting in uniform coverage of the endmost threads of the pipe with corrosion resistant powder without any holes or voids in the coating. The unique configuration of the air mask ensures sharp, clean cutoff of the coating beyond a specified number of coated threads These and other objects and advantages of the invention of this application will be more readily apparent from the following description of the drawings.

BRIEF DESCRIPTION OF THE DRAWINGS

FIG. 1 is a side elevational view, partially broken away, of a powder spray apparatus used in the practice of this invention.

FIG. 2 is a bottom plan view of the apparatus of FIG. 1, but omitting the threaded pipe from the Figure.

FIG. 3 is a cross-sectional view taken on line 3—3 of FIG. 1.

FIG. 4 is a cross-sectional view taken on line 4—4 of FIG. 1.

With reference to the drawings, and particularly to FIG. 1, there is illustrated a nozzle assembly 10 utilized in the practice of this invention. This nozzle assembly is operative to direct air-entrained powder from a powder source 12 onto the threaded endmost section 14 of a pipe 16. The threads 18 of the pipe 16 extend well beyond the endmost section 14, which endmost section 14 is to be coated with solid particulate powder from the nozzle assembly 10. The reason for coating less than all of the threads of the pipe 16 is to enable an electrical connection to be made through the uncoated threaded section of the pipe 14. The threaded end of the pipe is customarily threaded into a coupling (not shown) to a greater depth than the coated endmost section 14 with the result that electrical contact may be established from the threaded but uncoated section of one pipe, through a coupling, to the threaded and uncoated section of the adjacent pipe. In this way, electrical contact may be established through multiple couplings and multiple sections of pipe with the result that the pipe can be used in the oil or gas industry without the danger of an electrical charge building up on the interior of the pipe and causing a spark and resulting fire or explosion.

In the use of the nozzle assembly 10, powder 13 from the source 12 is supplied to a primary nozzle 20 through a triboelectric charge applying means 22. One triboelectric electric charge applying means suitable for use in this application is disclosed in U.S. Pat. No. 4,399,945. This tribocharged powder is supplied to the primary nozzle 20 via a conduit 24. At its upper end 20*a*, the primary nozzle 20 is circular in cross section, while at its lower or discharge end 20*b*, it is generally oblong with a bulbous enlargement 30 on one side.

Mounted within the discharge end 20*b* of the primary nozzle 20 there is a flow divider 34. This flow divider is generally rectangular in cross section and is tapered to a sharp edge 36 at its upper or upstream end. The purpose of this divider 34 is to divide the stream of air-entrained powder passing through the nozzle 20 into two streams or flow paths 38 and 40 located on opposite sides of the divider. One of these flow paths 38 terminates in a generally rectangular discharge orifice 32, while the other 40 leads into the bulbous side section 30 of the nozzle 20. Located within this bulbous side section 30 there is a tube nozzle or auxiliary nozzle 42, the upper end of which is slidably received within the bulbous enlargement 30. The lower end of this tube 42 is curved inwardly and terminates in a discharge orifice 46 which is directed generally parallel to the axis 45 of the pipe 16. The discharge orifice 46 of this auxiliary or tube nozzle 42 is positioned such that it directs air-entrained powder from the auxiliary nozzle 42 onto the chamfered end 48 and the endmost threads 50 of the pipe 16.

In lieu of directing the orifice 46 of the auxiliary nozzle 42 parallel to the axis 45 of the pipe, the orifice 46 may be angled relative to the axis of the pipe so that the stream of powder emitted from the auxiliary nozzle contacts the chamfered end 48 of the pipe at an angle relative to the axis of the pipe.

It will now be understood that tribocharged, air-entrained powder supplied to the primary nozzle 20 is caused to flow through that nozzle and to be divided into two streams, one stream of which 38 is directed to the generally rectangular-shaped discharge orifice 32 of the nozzle, and the other stream 40 of which is directed to the tube or auxiliary nozzle 42. The discharge orifices of these nozzles are directed onto the endmost section 14 of the pipe.

In a typical application, powder sprayed from the nozzle assembly 20 onto the end of the pipe 16 is a fusion bond corrosion resistant material, such as an epoxy powder material manufactured and sold by the Morton Thiokol Company of Wytheville, Va., and identified as their Green End Coat, Product No. 10-6064. Of course, the nozzle assembly of this invention could be used to spray other corrosion resistant powders or other powders onto the endmost threaded section of a pipe.

A generally yoke-shaped bracket 51 is mounted over the lower end 20*b* of the primary nozzle 20. This bracket comprises two legs 52, 54 (FIG. 4) located on opposite sides of the discharge end 20*b* of the nozzle 20 and interconnected by a web section 56. The free ends of the bracket 51 extend beyond the side edge of the nozzle 20 and are interconnected by a screw 58 which passes through a hole 60 in one leg 52 and is threaded into a threaded hole 62 of the other leg. Tightening of this screw enables the bracket to be adjustably clamped to the exterior of the nozzle 20.

Mounted within the web section 56 of the bracket 51 there are a pair of gas nozzles 66, 68. Each of these gas nozzles has a circular cross section upper end 66*a*, 68*a* frictionally received and secured within an air passage 70, 72 of the bracket 51. These air passages 70, 72 communicate via a connecting air passage 74 with an air fitting 76 threaded into the bracket 51. This fitting 76 connects the air passage 74 of the bracket to a source 78 of high pressure air 70 via an air hose 80.

Both of the nozzles 66, 68 are circular in cross section at their upper ends, and each is oblong at its lower or discharge end 66*b*, 68*b* such that each air nozzle 66, 68 terminates in an oblong discharge orifice 66*c*, 68*c* (FIGS. 2 and 3). The discharge orifice 68*c* of the air nozzle 68 is oriented such that the long axis 68*d* of the nozzle is oriented perpendicular to the longitudinal axis of the pipe 16, while the long axis 66*d* of the nozzle orifice 66*c* is located parallel to that longitudinal axis 45. The two nozzles are located immediately adjacent one another with the nozzle 66 directed onto that thread of the pipe which is located immediately adjacent to the endmost coated thread of the pipe. This configuration and orientation of the air nozzles 66, 68 enables high pressure airstreams directed through the nozzles 66, 68 to effectively mask that threaded section 82 of the pipe which is located immediately adjacent to the endmost threaded section 14 from powder sprayed from the powder spray nozzle orifices 32 and 46 and prevents oversprayed powder from contacting that adjacent threaded section 82.

In the preferred embodiment of this invention, all of the components of the nozzle assembly 10 are made from plastic materials which are incapable of storing a capacitive electrical charge. The primary nozzle 20 may be made from "Teflon" or other suitable strength and abrasion resistant plastic material. The flow divider 34 is, in one preferred embodiment, manufactured from an acrylic plastic, while the bracket 51 is, in one preferred embodiment, manufactured from "Delrin TM" plastic. The tube nozzle or auxiliary nozzle 42 and the air nozzles 66, 68 are, in one preferred embodiment, manufactured from "Teflon." These materials are primarily chosen for their electrical properties, their physical strength, and their abrasion resistant characteristics.

It is to be noted that the bracket 51 is adjustably secured to the exterior of the primary nozzle 20 such that the bracket may be raised or lowered on the nozzle by simply loosening the screw 58, sliding the bracket up or down on the primary nozzle, and then retightening the screw 58. Similarly, the auxiliary tube nozzle 42 may be vertically adjusted relative to a pipe by simply sliding the tube up or down in the bore of the primary nozzle 20 within which it is frictionally secured. And, similarly, the air nozzles 66, 68 may be vertically adjusted within the bores in which they are frictionally secured by simply sliding the nozzles up or down in the bores.

In the use of the nozzle assembly 10, air-entrained, corrosion resistant powder material is supplied to the inlet of the primary nozzle 20 through the conduit 24. In the course of passage from a source of powder 12 to the nozzle 20, a triboelectric charge is applied to the powder. This charge on the powder causes the powder to be attracted to the grounded and heated pipe when it is sprayed from the discharge orifice 32 of the primary nozzle 20 or the discharge orifice 46 of the auxiliary nozzle 42. This air-entrained electrostatically charged powder flows through the primary nozzle 20 and is divided into two streams 38 and 40 by the flow divider 34. One of these streams is emitted from the orifice 32 onto the threads of the endmost portion or section 14 of the pipe 16 while that pipe is rotated relative to the nozzle assembly 10 about the axis 45 of the pipe. Simultaneously, air-entrained powder is directed from the stream 40 of the primary nozzle 20 through the auxiliary nozzle 42 onto the chamfered end 48 and the endmost threads 50 of the pipe. By utilizing both the primary nozzle 20 and the auxiliary nozzle 42 to apply powder to the end section 14 of the pipe, the complete end surface of the pipe as well as the endmost threads, are coated with the corrosion resistant powder coating.

While powder is sprayed from the primary nozzle 20 and auxiliary nozzle 42, high pressure air is directed through the air nozzles 66, 68 onto that threaded portion of the pipe located immediately adjacent to the endmost section 14. These airstreams act as an effective mask to prevent oversprayed powder from contacting and adhering to the surface of that threaded section 82 of the pipe located adjacent to the endmost threaded section 14.

By maintaining that threaded section 82 of the pipe which is located adjacent to the coated section 14 free from powder, good electrical contact is ensured between the uncoated threaded section 82 of the pipe and a pipe coupling (not shown) utilized to interconnect the ends of two series of connected pipes. Thereby, one section may be grounded through another section via the interconnecting coupling. Such grounding is particularly important in the case of pipes utilized in the oil and gas industry where it is important that all sections of the pipe be grounded in order to avoid the buildup of an electrical charge on any one section of the pipe, which buildup can occur if any one section is not effectively grounded.

While we have described only a single preferred embodiment of our invention, persons skilled in the art to which this invention applies will appreciate numerous changes and modifications which may be made without departing from the spirit of our invention. Therefore, we do not intend to be limited except by the scope of the following appended claims.

We claim:

1. Apparatus for coating the endmost threaded portion of a pipe with solid particulate powder material, which apparatus comprises means for rotating a pipe about a longitudinal axis of said pipe, said pipe having a threaded end portion, means including a conduit for supplying a stream of air-entrained powder to a spray nozzle, said spray nozzle having a discharge orifice, said nozzle being operative to direct said air-entrained powder from said discharge orifice of said nozzle onto a first threaded end portion of said rotating pipe, means for directing a stream of gas onto a second portion of said pipe, said second portion of said pipe being located immediately adjacent to said first threaded end portion, said stream of gas being operative as a mask to prevent air-entrained powder from contacting said second portion of said pipe so as to obtain a sharp line of demarcation between the powder coated first threaded end portion of said pipe and the uncoated second portion of said pipe, and means for dividing said stream of air-entrained powder into two streams of air-entrained powder before said powder is directed from said discharge orifice of said nozzle, one of said streams of air-entrained powder being directed onto an endmost thread of said pipe and the other of said streams of air-entrained powder being directed onto said threaded portion at an angle generally perpendicular to the threads of said threaded portion.

2. The apparatus of claim 1 wherein each of said first and second gas nozzles have discharge orifices which are generally oblong in cross-sectional configuration with a long axis and a short axis, said first gas nozzle being oriented with the long axis of the first gas nozzle generally perpendicular to the longitudinal axis of said pipe, and said second gas nozzle being oriented with the long axis of the second gas nozzle generally parallel to the longitudinal axis of said pipe.

3. The apparatus of claim 1 wherein said apparatus includes means for directing said one stream of powder generally parallel to the axis of said pipe onto said endmost thread of said pipe.

4. Apparatus for coating the endmost threaded portion of a pipe with solid particulate powder material, which apparatus comprises means for rotating a pipe about a longitudinal axis of said pipe, said pipe having a threaded end portion, means including a conduit for passing a stream of air-entrained powder to a powder spray nozzle, said powder spray nozzle having a discharge orifice, means for applying an electrostatic charge to said powder before it emerges from said nozzle, means for dividing said stream of air-entrained powder into first and second streams of air-entrained powder before said powder emerges from said discharge orifice of said nozzle, means for directing said first stream of air-entrained, electrostatically charged powder onto an end thread of said pipe, means for directing said second stream of air-entrained, electrostatically charged powder from said discharge orifice of said nozzle onto a first threaded end portion of said rotating pipe, means including a first gas nozzle for directing a first stream of gas onto a second portion of said pipe, said second portion being located immediately adjacent to said first threaded end portion, means including a second gas nozzle for directing a second stream of gas onto a third portion of said pipe located immediately adjacent said second portion, said streams of gas being operative as a mask to prevent air-entrained powder from contacting said second and third portions of said pipe so as to obtain a sharp line of demarcation between the powder coated first threaded end portion of said pipe and the uncoated second portion of said pipe, and each of said first and second gas nozzles having discharge orifices which are generally oblong in cross-sectional configuration with a long axis and a short axis, said first gas nozzle being oriented with the long axis of the discharge orifice generally perpendicular to the longitudinal axis of said pipe, and said second gas nozzle being oriented with the long axis of the discharge orifice generally parallel to the longitudinal axis of said pipe.

5. A nozzle assembly for use in spraying solid particulate powder, said nozzle assembly comprising a primary powder spray nozzle having a discharge orifice, a flow divider located in said primary powder spray nozzle and operative to divide a stream of air-entrained powder flowing through said primary powder spray nozzle into first and second streams before said air-entrained powder passes from said primary powder spray nozzle, an auxiliary powder spray nozzle mounted upon said primary powder spray nozzle, said auxiliary powder spray nozzle being in fluid communication with said primary powder spray nozzle and being operative to receive all of the flow of said second stream of powder, a mounting bracket mounted on the exterior of said primary powder spray nozzle, and at least one gas nozzle mounted upon said mounting bracket for directing a masking gas stream toward one edge of the stream of powder discharged from said nozzle assembly.

6. The nozzle assembly of claim 5 wherein said primary and auxiliary powder spray nozzles are oriented so that a flow stream of powder emitted from said auxiliary nozzle is directed angularly relative to the flow from said primary nozzle.

7. The nozzle assembly of claim 6 wherein said at least one gas nozzle is mounted upon said mounting bracket.

8. The nozzle assembly of claim 7 which includes two gas nozzles and wherein each of said gas nozzles has a discharge orifice which is generally oblong in cross-sectional configuration with a long axis and a short axis, said discharge orifices of said gas nozzles being located adjacent one another with one of said gas nozzles having the long axis of its discharge orifice oriented generally perpendicular to the long axis of the discharge orifice of the other gas nozzle.

9. A nozzle assembly for use in spraying solid particulate powder, said nozzle assembly comprising a primary powder spray nozzle having a discharge orifice, a flow divider located in said primary powder spray nozzle and operative to divide a stream of air-entrained powder flowing through said primary powder spray nozzle into first and second streams before said air-entrained powder passes from said primary powder spray nozzle, an auxiliary powder spray nozzle mounted adjacent said primary powder spray nozzle, said auxiliary powder spray nozzle being in fluid communication with said primary powder spray nozzle and being operative to receive the flow of said second stream of powder, and at least one gas nozzle mounted in close adjacency to said primary spray nozzle for directing a masking gas stream toward one edge of a stream of powder discharged from said nozzle assembly.

10. The nozzle assembly of claim 9 wherein said primary and auxiliary powder spray nozzles are oriented so that a flow stream of powder emitted from said auxiliary nozzle is directed angularly relative to a flow stream of powder from said primary nozzle.

11. A powder spray nozzle assembly comprising a powder spray nozzle having a discharge orifice for spraying air-entrained solid particulate powder, a first gas nozzle mounted upon said assembly in close adjacency to said powder spray nozzle for directing a masking gas stream toward one edge of a stream of air-entrained powder discharged from said powder spray nozzle, and a second gas nozzle mounted upon said assembly, each of said gas nozzles having a discharge orifice which is generally oblong in cross-sectional configuration with a long axis and a short axis, said discharge orifices of said gas nozzles being located adjacent one another with one of said gas nozzles having the long axis of its discharge orifice oriented generally perpendicular to the long axis of the discharge orifice of the other gas nozzle.

* * * * *